US012674598B2

(12) United States Patent
Botruff et al.

(10) Patent No.: US 12,674,598 B2
(45) Date of Patent: Jul. 7, 2026

(54) ENVIRONMENTAL CONDITIONING EQUIPMENT

(71) Applicant: Weiss Technik North America, Inc., Grand Rapids, MI (US)

(72) Inventors: Dwayne Botruff, Byron Center, MI (US); Lew Huguelet, Wyoming, MI (US); Sean McKendry, Alto, MI (US); Michael Stratton, Kentwood, MI (US)

(73) Assignee: Weiss Technik North America, Inc., Grand Rapids, MI (US)

( * ) Notice: Subject to any disclaimer, the term of this patent is extended or adjusted under 35 U.S.C. 154(b) by 515 days.

(21) Appl. No.: 18/186,286

(22) Filed: Mar. 20, 2023

(65) Prior Publication Data

US 2024/0318860 A1 Sep. 26, 2024

(51) Int. Cl.
*F24F 13/06* (2006.01)
*F24F 7/04* (2006.01)

(52) U.S. Cl.
CPC ..... *F24F 13/06* (2013.01); *F24F 7/04* (2013.01)

(58) Field of Classification Search
CPC ..... F24F 13/06; F24F 7/04; B60H 1/00371; B60H 1/245
See application file for complete search history.

(56) References Cited

U.S. PATENT DOCUMENTS

| | | | | |
|---|---|---|---|---|
| 6,272,767 | B1 | 8/2001 | Botruff et al. | |
| 10,935,486 | B2 | 3/2021 | Johnston et al. | |
| 2014/0335775 | A1 | 11/2014 | Clark | |
| 2019/0329797 | A1 * | 10/2019 | Davis | B60H 1/00371 |

FOREIGN PATENT DOCUMENTS

| | | | | |
|---|---|---|---|---|
| CN | 111109645 A | * | 5/2020 | F24F 13/02 |
| CN | 111306869 A | | 6/2020 | |
| CN | 13778130 U | | 7/2021 | |
| CN | 113685905 A | | 11/2021 | |
| JP | 2013103573 A | * | 5/2013 | |

OTHER PUBLICATIONS

JP2013103573 and translation (Year: 2013).*
CN111109645 and translation (Year: 2020).*

* cited by examiner

*Primary Examiner* — Steven S Anderson, II
(74) *Attorney, Agent, or Firm* — Gardner, Linn, Burkhart & Ondersma LLP

(57) ABSTRACT

An environmental conditioning equipment having a chamber, and method of directing fluid through the chamber, includes a chamber, a plenum and an air-moving apparatus for directing air into said chamber via the plenum, and a duct. The duct is formed from a base wall and opposed side walls forming two sides of the duct. Each of the side walls has a plurality air flow openings configured to direct fluid outwardly from the sides of said duct and form air flow areas that decrease is size along the longitudinal axis of the duct.

23 Claims, 16 Drawing Sheets

ENVIRONMENTAL CONDITIONING EQUIPMENT

TECHNICAL FIELD AND BACKGROUND

The present disclosure is directed to environmental conditioning equipment and to a method of directing fluid flow through the environmental conditioning equipment. Environmental conditioning equipment maybe used for testing or storage, for example. When used as testing equipment, the testing equipment may be used to qualify a product, including equipment, as being capable of withstanding a variety of environmental conditions. Such environmental conditions may include, for example, temperature, humidity, altitude, and radiation, including infrared light, ultraviolet light, and solar radiation, to simulate a variety of conditions, such as wind and rain etc. If the product or equipment under test performs satisfactorily after being subjected to the wide range of parameters, it can be expected that the product or equipment will perform in real life conditions.

One challenge facing, especially for environmental conditioning equipment with large chambers, is the ability to provide a uniform temperature distribution within the chamber. In other words, controlling the temperature gradient within the chamber can be especially challenging for large chambers. As defined by International Electrotechnical Commission (IEC) 60068-3-5 (2018 January), the temperature gradient is the "maximum difference in mean temperature in all measurement points of the effective space."

Temperature gradients are measured within an effective/working space. As defined by IEC 60068-3-5 (2018 January) the "working space" is "part of the chamber in which the specified conditions can be maintained within the specified tolerances." The dimensions of the working space are described in the IEC 60068-3-5 diagram. The measurement sensors are then placed at each corner of the working space as well as the center, shown in another IEC 60068-3-5 diagram. The values are recorded, averaged, and then compared to calculate the gradient, shown in a final IEC 60068-3-5 diagram.

Temperature gradients are important because they quantitatively describe the distribution of temperature within an environmental test chamber. The smaller the value, the more uniform the air temperature is throughout the effective space, which assists in evenly transitioning a test sample's temperature.

Test chambers with tight gradients improve the reliability and repeatability of simulated environmental conditions. While this applies for all test chambers, as noted above, it is especially challenging for test chambers with large working spaces where the probability of poor gradients increases.

SUMMARY OF THE DISCLOSURE

An environmental conditioning equipment includes a chamber having an upper wall forming a ceiling of the chamber, two opposed side walls, two opposed end walls, and a lower wall forming a floor of the chamber. The environmental conditioning equipment also includes a plenum and an air-moving apparatus for directing air into the chamber and a duct. The duct is in fluid communication with the plenum at its proximal end. The duct has opposed sides and is formed from a base wall and opposed side walls forming the opposed sides of the duct. Each of the side walls has a plurality air flow openings configured to direct fluid outwardly from the sides of the duct and form an air flow area that decreases along the longitudinal axis. Optionally, the base wall is free of air flow openings.

In one aspect, the plurality of the air flow openings is arranged in groups.

In a further aspect, a first side wall of the side walls has at least two groups of the air flow openings. A second side wall of the side walls has at least two groups of the air flow openings wherein the at least two groups of the air flow openings of the first side wall are aligned with the at least two groups of the air flow openings in the second side wall.

Optionally, the groups have (1) a uniform number of openings, (2) a uniform size of openings, and/or (3) uniform shaped openings.

In another aspect, the air flow openings of each group comprise uniformly sized and shaped slotted air flow openings spaced uniformly along the longitudinal axis of the duct.

Optionally, the plurality of air flow openings are adjustable to vary the air flow area along the longitudinal axis of the duct.

In further aspect, the air flow openings are arranged in groups of openings, with each respective group of openings having a slidable plate extending over the respective group of openings to adjust the air flow area of each respective group of openings.

In another aspect, each of the side walls extends along a respective longitudinal axis, with the respective longitudinal axes converging toward the distal end of the duct wherein the duct is tapered inwardly from the duct's proximal end to the duct's distal end.

In another aspect, the side walls of the duct form inner obtuse angles with respect to the base wall wherein the duct has a trapezoidal cross-section and such that the air flow openings are angled downwardly toward the floor of the chamber. For example, the inner obtuse angles are approximately equal wherein the duct has a symmetrical trapezoidal cross-section.

In yet another aspect, the duct includes an end wall at its distal end, which may be closed and free of air flow openings.

In another aspect, the air flow openings are arranged in each respective side wall of the opposed side walls along the longitudinal axes, with the openings each having a size, and the openings in each respective side wall decreasing in size along the longitudinal axes.

In another aspect, the longitudinal axis of the duct is angled with respect to the upper wall wherein the duct is not horizontal.

In another aspect, the duct includes a plurality of transverse members extending between the opposed side walls, with the transverse members each having an angled surface facing the proximate end of the duct to help direct the flow of air toward the base wall in the duct.

In another aspect, the duct is formed from a plurality of duct sections joined together at spaced connections, with each duct section being formed from a base wall section and opposed side wall sections joined together to form the base wall and the side wall, and with the transverse members being mounted at the spaced connections.

In still yet another embodiment, the duct comprises a first duct, and the environmental conditioning equipment further comprises a second duct.

For example, the second duct has a proximal end, a distal end, and a longitudinal axis extending between the proximal end to the distal end of the second duct and is mounted at the upper wall of the chamber adjacent the first duct. The second duct is in fluid communication with the same plenum or a different plenum at its proximal end so that the two ducts may provide the same or different treatment to the air flowing in to the chamber via the two ducts.

In a further aspect, the second duct has opposed sides and is formed from a base wall and opposed side walls forming the opposed sides of the second duct. The second duct has a plurality air flow openings configured to direct fluid outwardly from the opposed sides of the second duct and form air flow areas that decrease along the longitudinal axis of the second duct.

These and other aspect of this disclosure will become apparent upon review of the following specification in conjunction with the drawings.

DESCRIPTION OF THE PREFERRED EMBODIMENT

Referring now to FIGS. 1-7, an environmental conditioning equipment 10 includes a housing 12 with at least one chamber 14 defining the working space of the environmental conditioning equipment. Equipment 10 is durable in construction and does not deform from when air is passing through it and is configured to withstand temperatures between −150° C. and +250° C., as well as temperature transitions up to 100° C./minute. The housing and chamber wall are made from durable, inert materials, such as stainless steel and, therefore, can be used across a wide range of environmental testing applications without deforming or degrading. As noted above, some of the applications may include simulated solar radiation, infrared light, and ultraviolet light testing, as well as explosion resistant testing (ATEX, Class/Div, EUCAR, etc.). Further, the housing and chamber are configured to withstand dust and climate testing (dry air, moist air, rain etc., all humidity applications, in other words 0% to 100% relative humidity). While air is the most common medium used within chamber 14 to condition a sample (and is used generally throughout this document), the chamber can also be used with Nitrogen (N2), Carbon Dioxide (CO2), and other gases or vapors. Finally, it can be used in applications that condition samples at sea (or site) level altitude, but also at simulated altitudes or pressures, such as pressures down to 5,000 feet below sea level and pressures up to an absolute vacuum. As will be more fully described below, chamber 14 includes one or more ducts 44 to better distribute the temperature through the chamber. The duct or ducts may be used in chambers of any internal volume, though they are particularly advantageous in chambers with large volumes.

Figure 1:
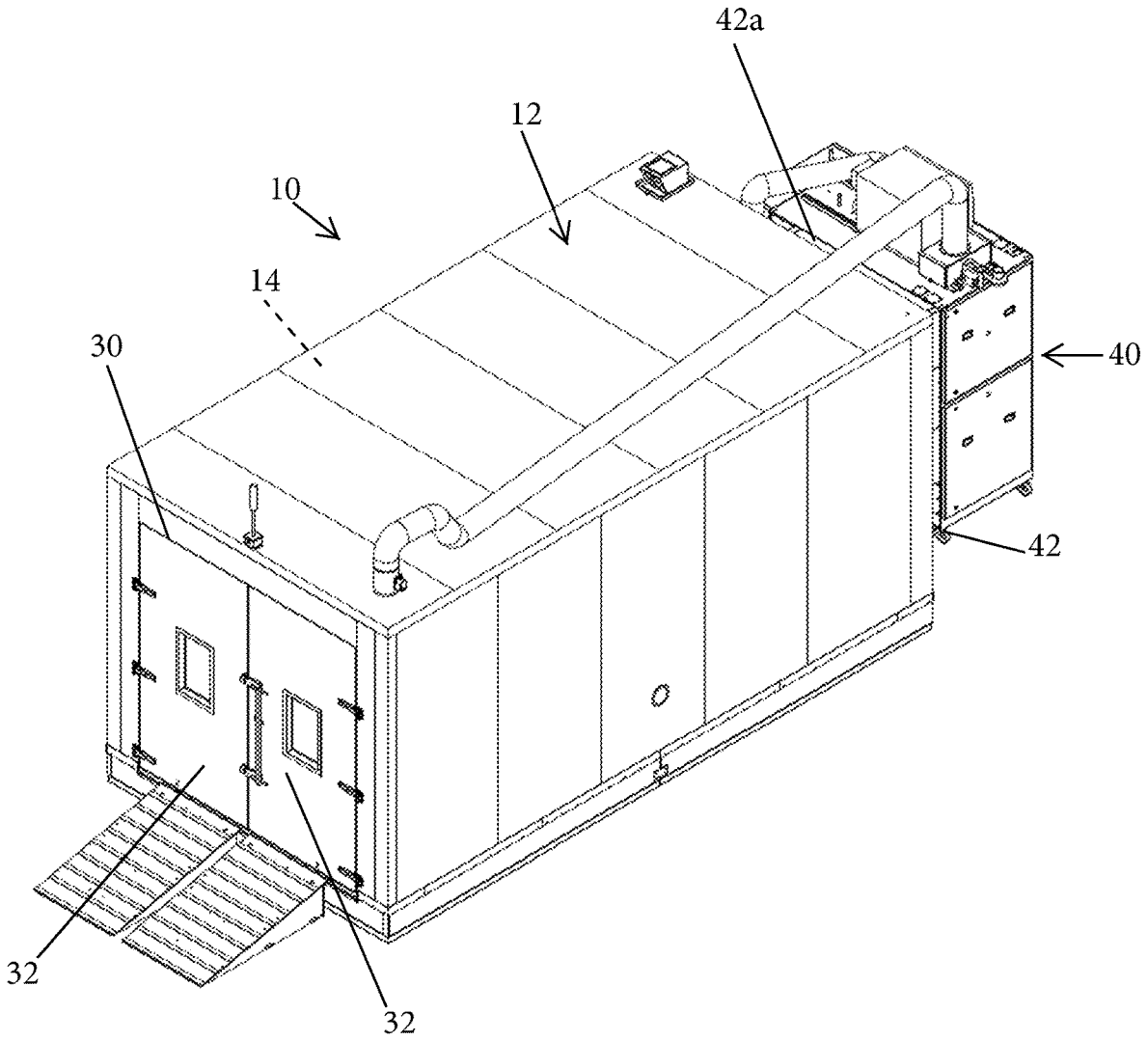
FIG. 1 is a first perspective view of an environmental conditioning equipment illustrated with an external plenum and conditioning system.
Figure 2:
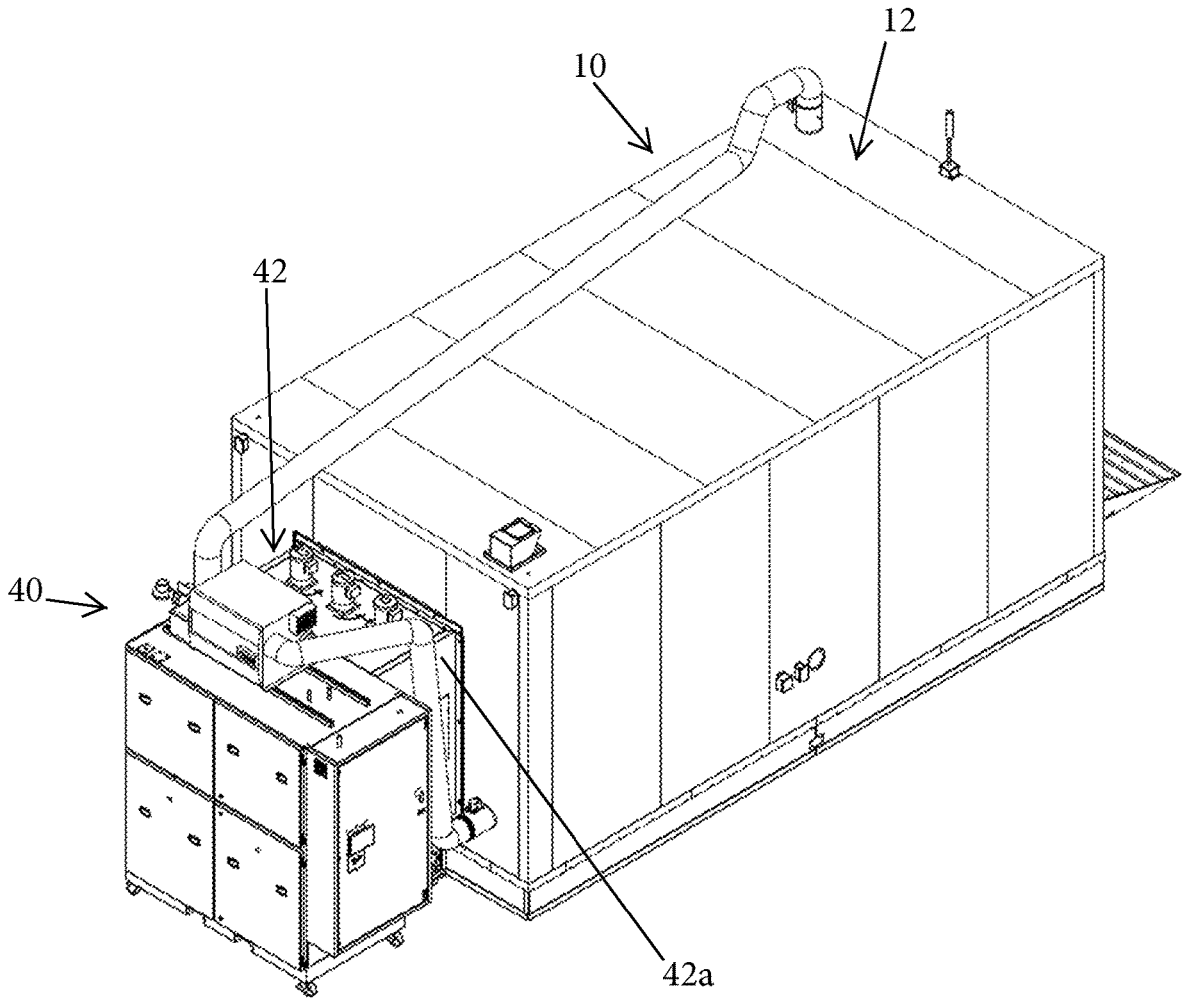
FIG. 2 is a second perspective view of the environmental conditioning equipment illustrating the external plenum and conditioning system.
Figure 3:
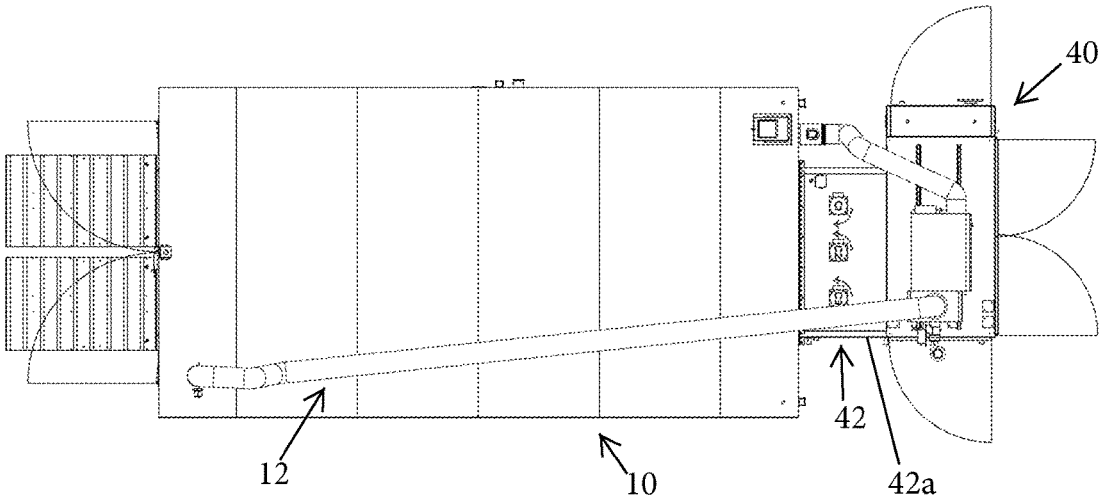
FIG. 3 is a top view of the environmental conditioning equipment of FIG. 1.
Figure 5:
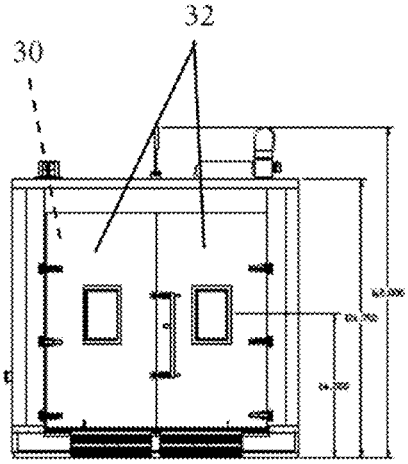
FIG. 5 is a second end elevation view of the environmental conditioning equipment.
Figure 4:
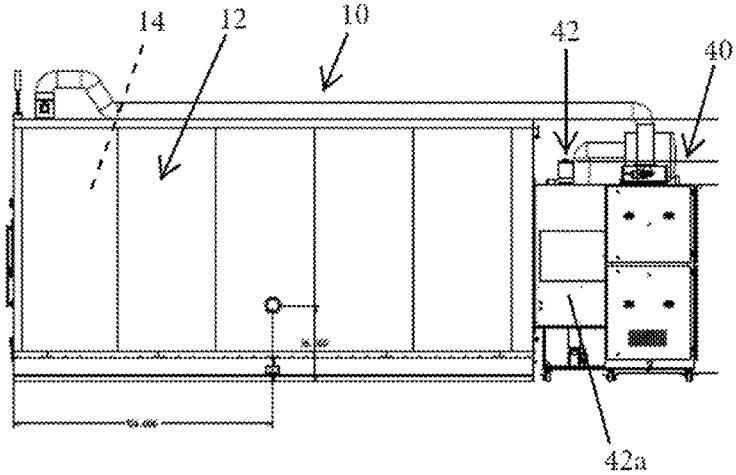
FIG. 4 is a side elevation view of the environmental conditioning equipment.
Figure 6:
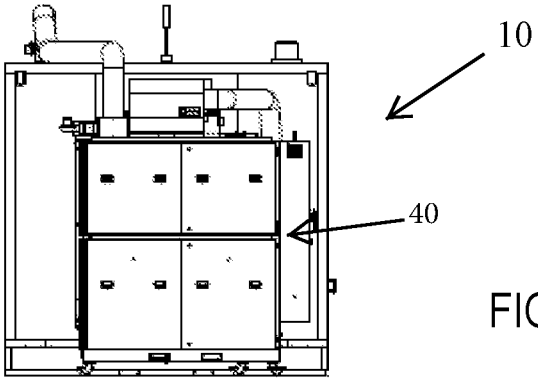
FIG. 6 is a first end elevation view of the environmental conditioning equipment.
Figure 7:
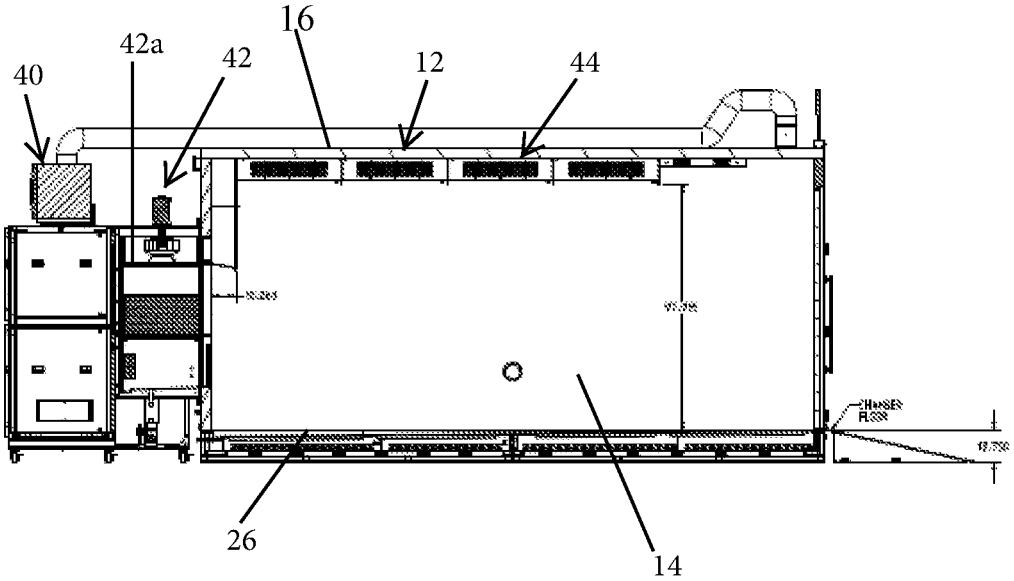
FIG. 7 is a cross-sectional view taken along line VII-VII of FIG. 3.
Figure 8:
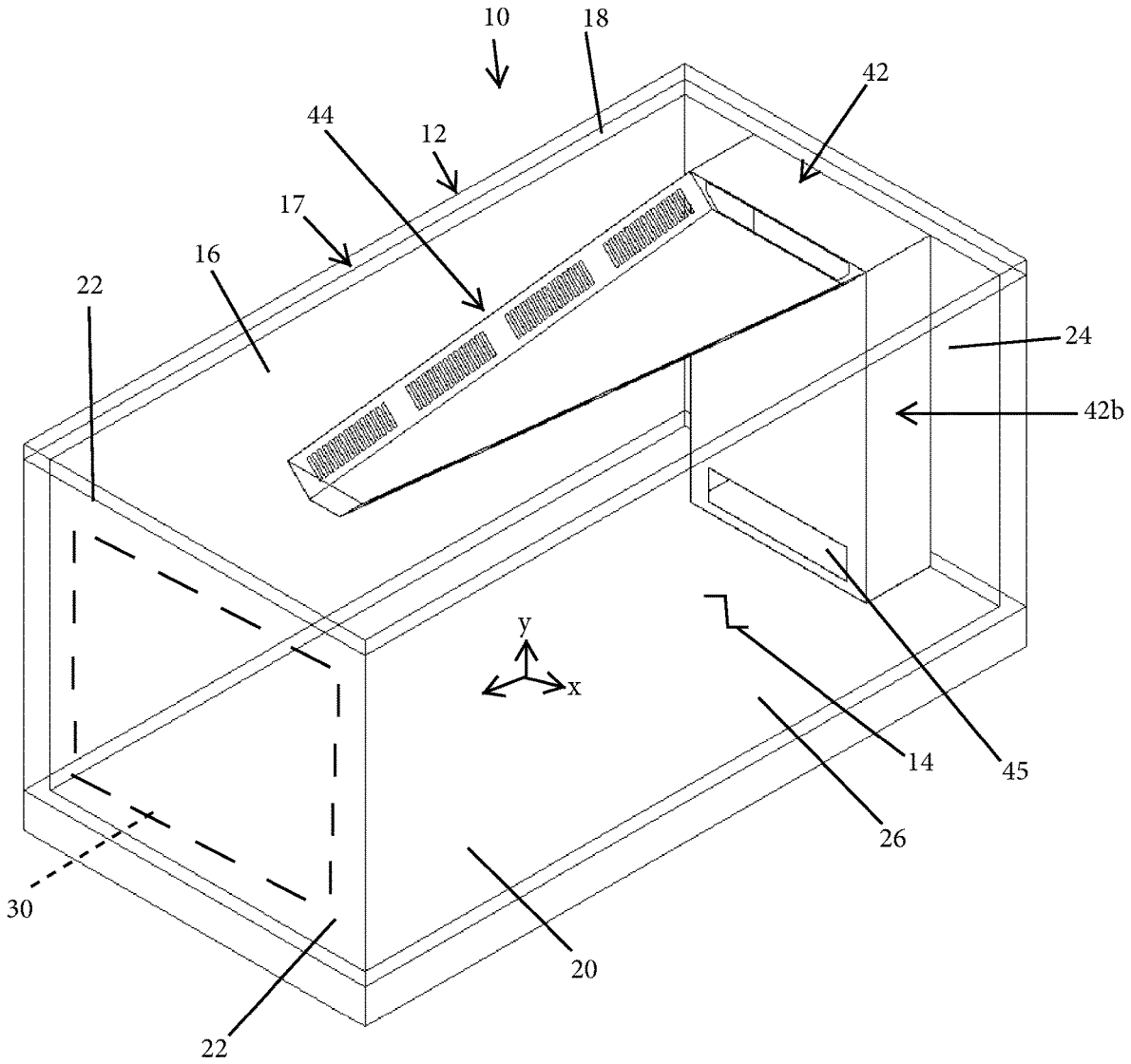
FIG. 8 is a perspective view (simplified with some details removed for clarity) of the environmental conditioning equipment illustrating a duct that extends though the interior of the environmental condition equipment with an internal plenum illustrated.
Figure 9:
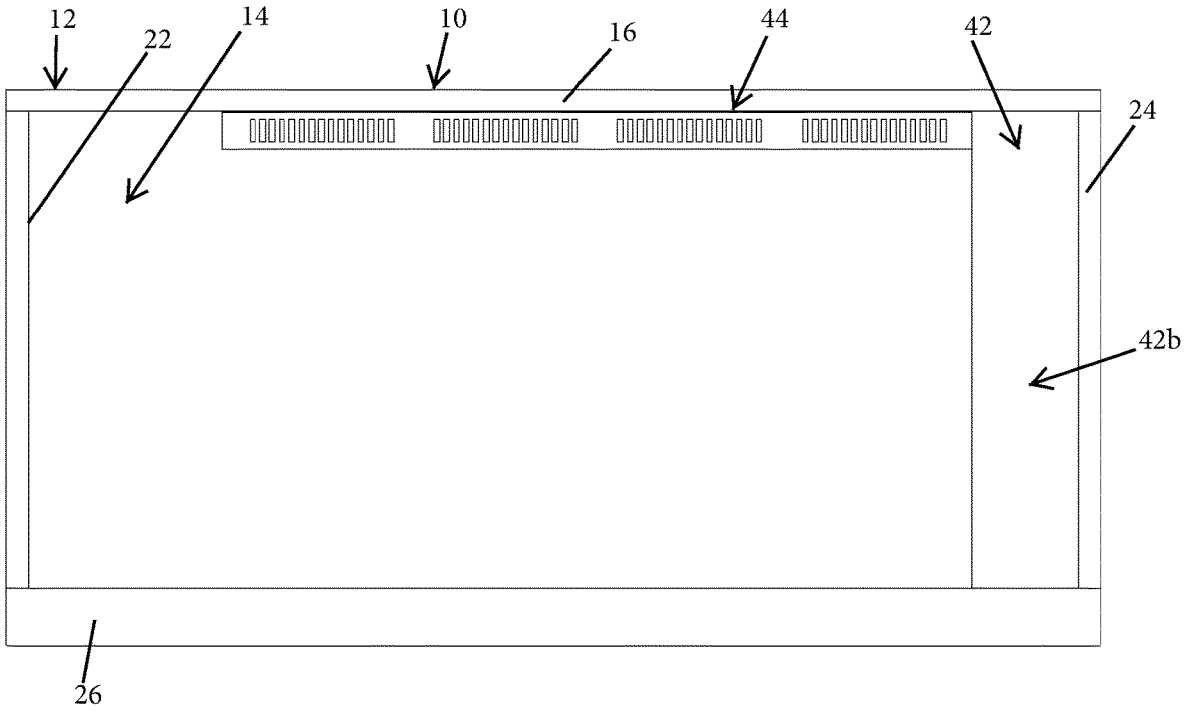
FIG. 9 is a side elevation view of the environmental conditioning equipment of FIG. 8 illustrating the duct.
Figure 10:
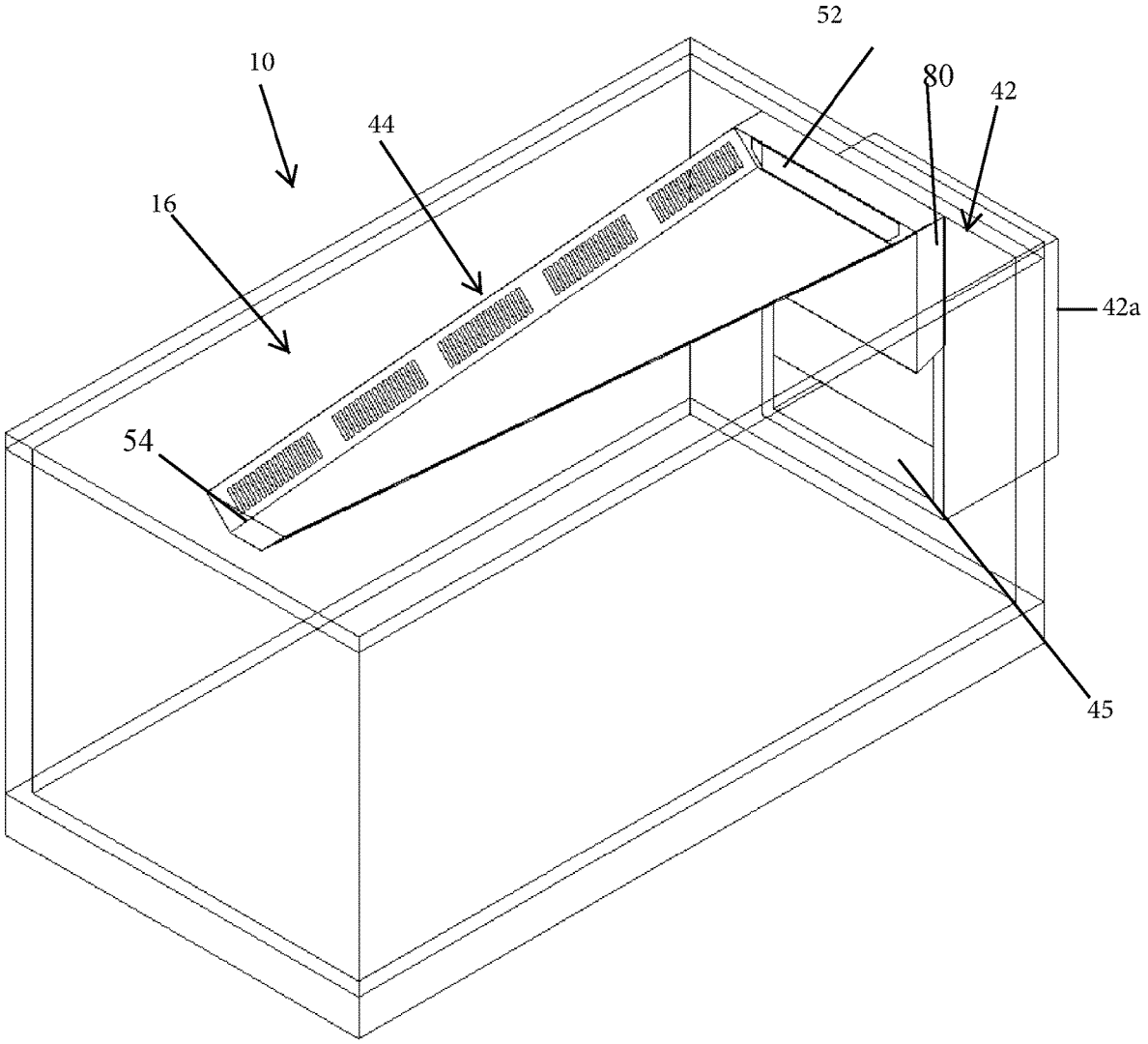
FIG. 10 is a perspective view showing the environment conditioning equipment with the external plenum.
Figure 11:
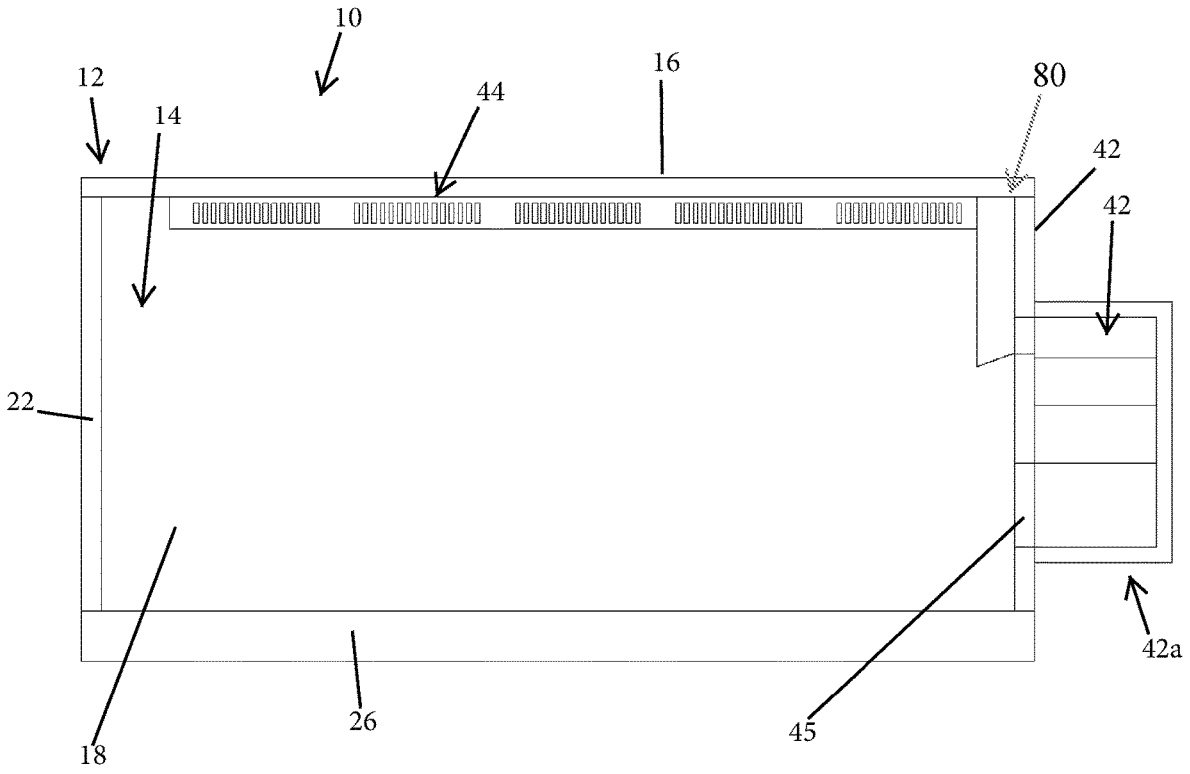
FIG. 11 is a perspective view of the environmental conditioning equipment of FIG. 10.
Figure 12:
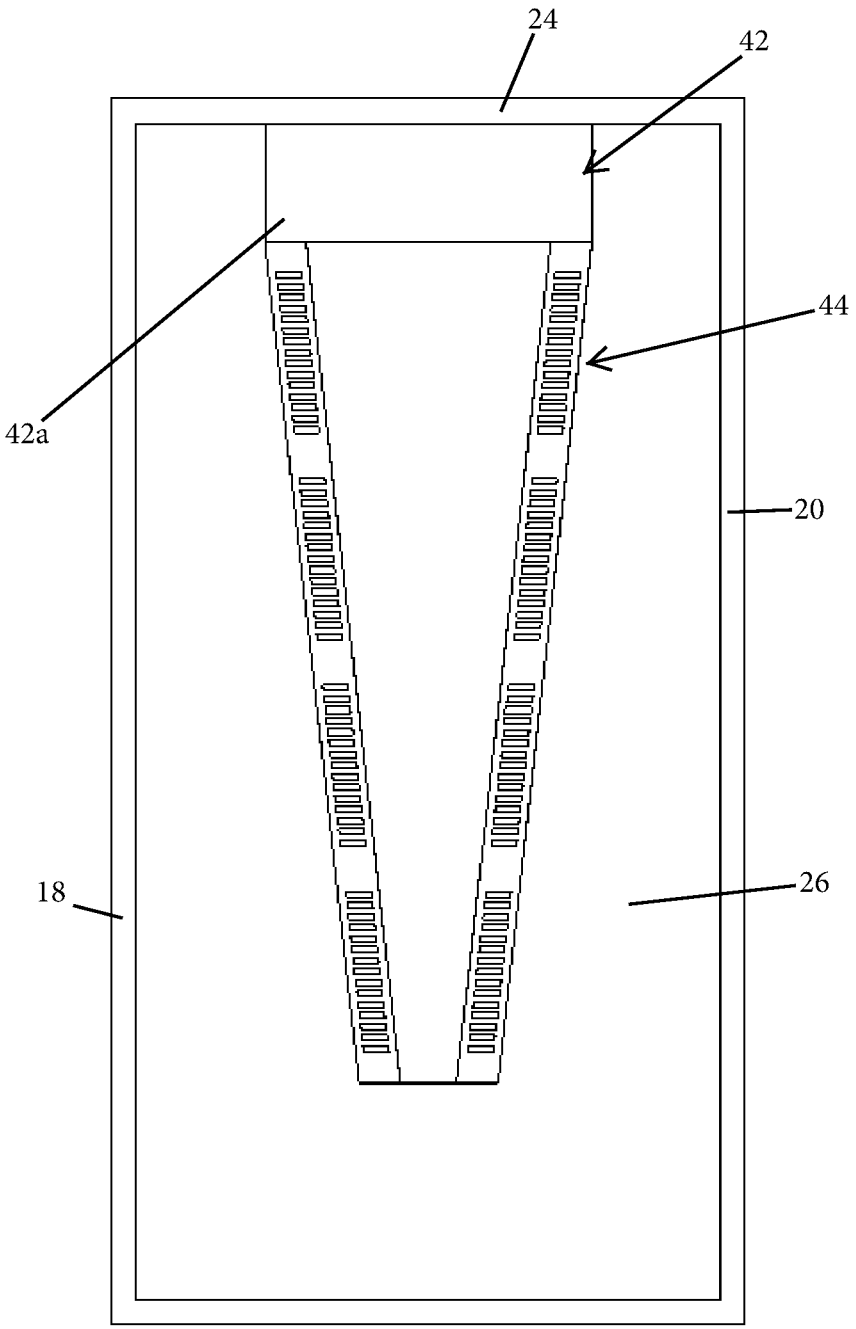
FIG. 12 is a top plan view of the environmental condition equipment of FIG. 9.

As seen in FIG. 8, chamber 14, which forms the working space, is defined between the inside surfaces of an upper wall 16, two opposed side walls 18, 20, two opposed end walls 22, 24, and a lower wall 26, which forms a floor of the chamber 14. Walls 16, 18, 20, 22, 24, and 26 may be formed by the housing walls or may comprise interior walls mounted to the housing walls by conventional fasteners and spaced inwardly from the housing walls, such as illustrated in FIG. 9, to form the chamber 14. Hereinafter the disclosure will be described in reference to the environmental conditioning equipment used as testing equipment and flowing air into the chamber. But it should be understood the scope of disclosure is not so limited as noted above.

Referring to FIG. 8, an access opening 30 is provided in end wall 22, which provides access to chamber 14 for an operator. The access opening 30 is closed by one or more doors 32 (FIG. 1), which selectively cover opening 30 and include one or more gaskets (not shown) to resist air leakage from chamber 14 when doors 30 are shut. One or more equipment access openings (not shown) may be provided in walls 16, 18, 20, 22, 24, and 26 to allow cabling, or the like, to be supplied to the units-under-test.

As best seen in FIGS. 1-4, 6, and 7, an air treatment system 40 is provided to treat the air flowing into chamber 14 and is in fluid communication with chamber 14 via a conditioning plenum 42 (e.g. FIGS. 2-4 and 7-11) and a duct 44. Plenum 42 includes a grill and an air-moving apparatus, such as a blower, (not shown) to direct the treated air into chamber 14. For details of a suitable plenum, reference is made to U.S. Pat. No. 6,272,767, which is incorporated by reference herein in its entirety. As will be more fully described below, plenum 42 may be an exterior plenum 42*a* as illustrated in FIGS. 2-4 and 7-9 or an interior plenum 42*b*, as illustrated in FIGS. 2-4 and 7-9.

Air treatment system 40 may heat or cool the air, as noted, and/or vary the pressure inside chamber 14, as well as introduce other treatments, such as other gases, radiation, to name a few. As will be more fully described below, duct 44 and conditioning plenum 42 form an internal vapor ducting system that directs the air into chamber 14 from air treatment system 40 and circulates the air back to the air treatment system 40 through a return vent 45 (e.g. FIGS. 8 and 10), and creates a balance between velocity and pressure when flowing the air into and out of chamber 14.

As best seen in FIGS. 8-12, duct 44 extends along the ceiling of chamber 14 (formed by upper wall 16) at least 25%, or in a range of 50-80%, or in some cases about 100%, of the full length of the chamber and is connected at one end to the conditioning plenum 42 (internal or externally mounted noted below), which is connected to the air treatment system 40. Thus, in the illustrated embodiment, duct 44 is mounted horizontally. The percentage of the full length of the chamber depends on the size of the chamber, both width and length. For example, for a test chamber with dimensions of about 10 ft. in width to 20 ft. in length, the percentage will fall in a range of 50 to 80%. As will be more fully described below, duct 44 improves temperature distribution within chamber 14, especially those chambers with large working spaces. In some embodiments, such as described below, two or more ducts may be used in parallel.

Figure 14:
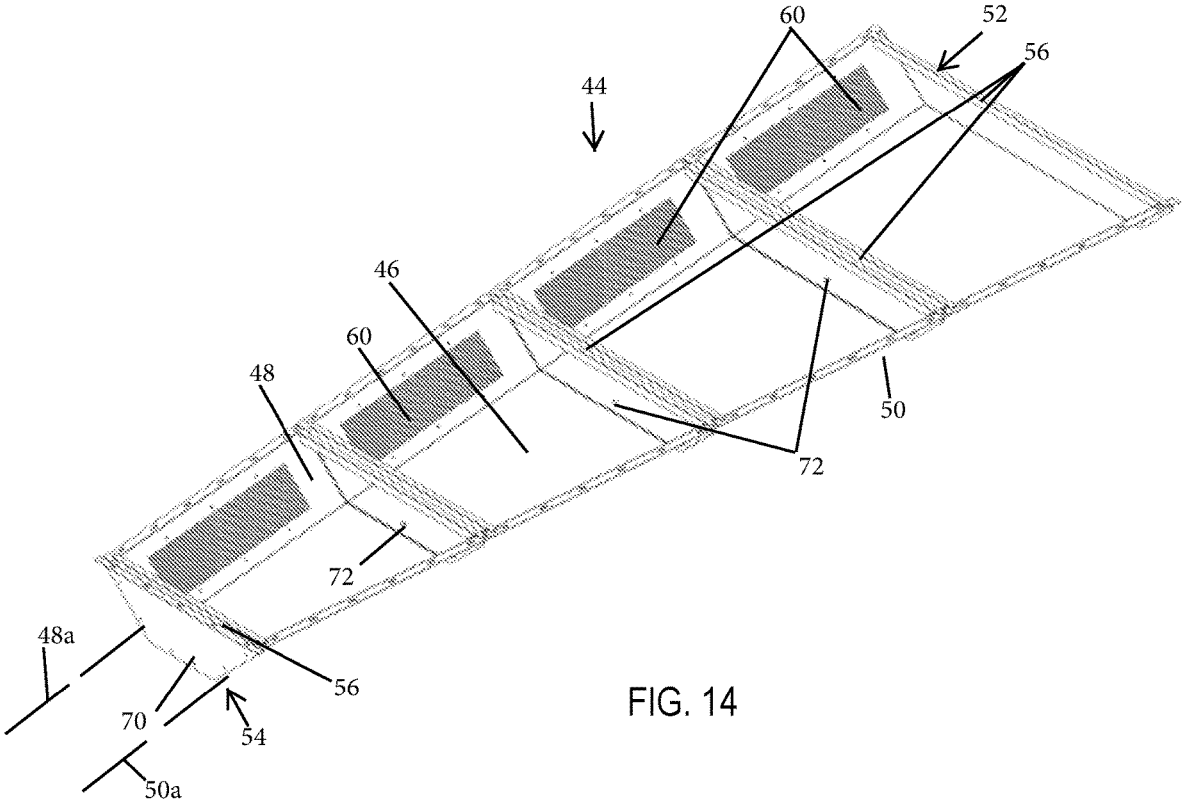
FIG. 14 is a top perspective view of the duct of FIG. 9 removed from the environmental condition equipment for clarity.
Figure 17:
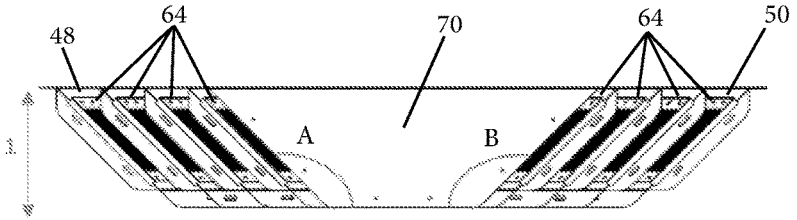
FIG. 17 is an end elevation view of the duct of FIG. 16.
Figure 15:
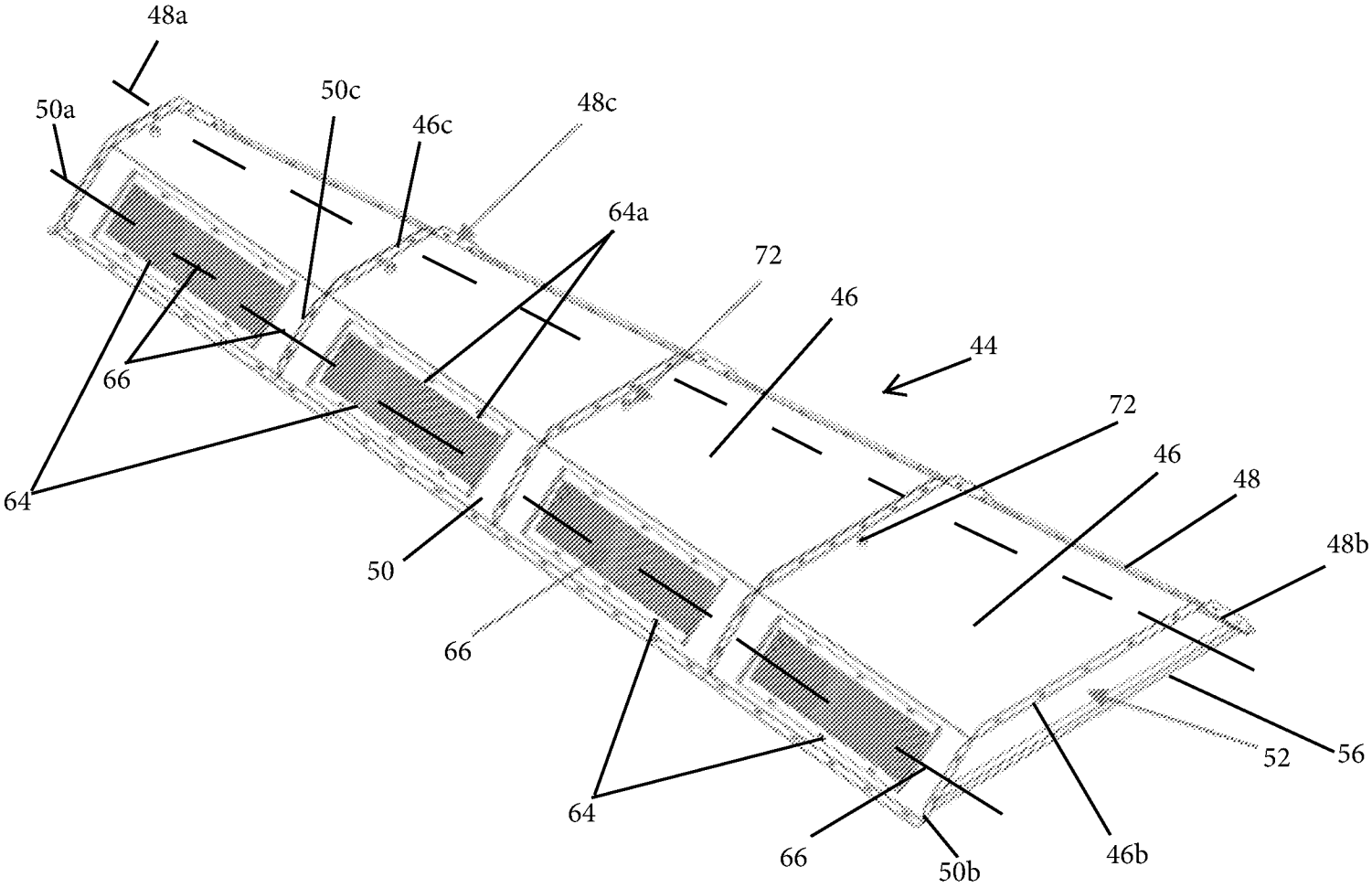
FIG. 15 is a bottom perspective view of the duct of FIG. 14.
Figure 16:
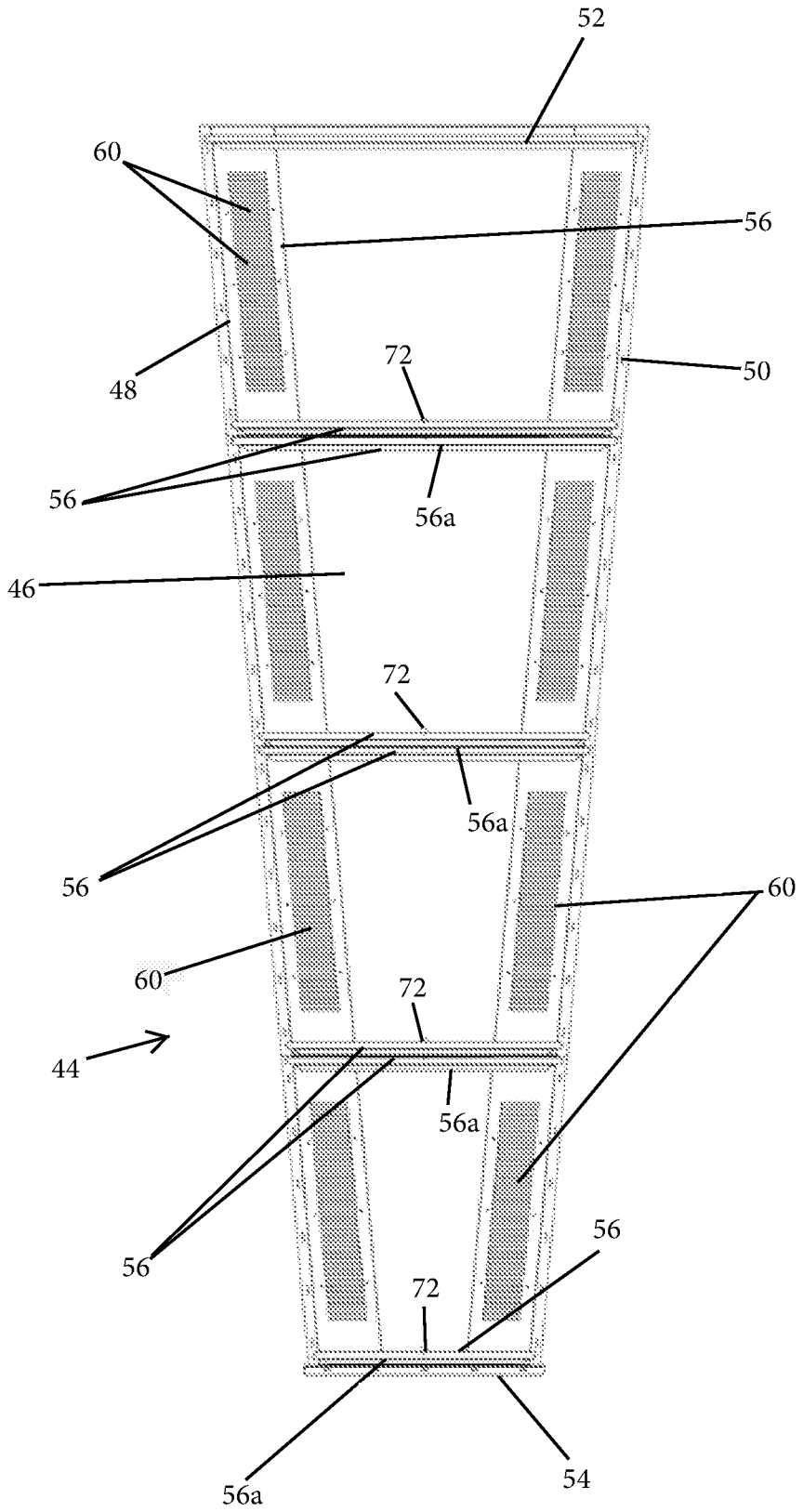
FIG. 16 is a top plan view of the duct of FIG. 14.

Referring to FIGS. 14, 15, and 17, duct 44 is mounted to upper wall 16 and has a trapezoidal shaped cross-section to form a closed channel shaped duct. Duct 44 includes a longitudinal axis that may be parallel to upper wall so that duct 44 is horizontal or it may be angled so that duct 44 is not horizontal. Duct 44 is formed from a base wall 46 and two angled side walls 48 and 50, each including a lip that forms a mounting flange with a plurality of mounting openings to allow the duct 44 to be fastened by fasteners (such as bolts or metal screws) to upper wall 16. A gasket or gaskets may be provided between the mounting flanges and upper wall 16 to seal the duct 44 against the upper wall 16.

Referring to FIGS. 12-17, duct 44 may be formed from a durable, inert material, such as stainless steel, and further may be made from duct sections (with each duct section being formed from a base wall section and two opposed side wall sections) that are then joined together via intermediate lips 46*c*, 48*c*, and 50*c* to form spaced connections, either during installation or pre-installation. Alternately, duct 44 may be pre-formed as a single unit with a continuous base wall and continuous side walls (e.g. walls 46, 48 and 50).

Referring again to FIG. 17, each side wall 48, 50 forms an internal angle A, B, respectively, relative to base wall 46 in a range of about 10 to 90 degrees, about 30 to 60 degrees, or about 40 to 50 degrees and, optionally, about 45 degrees. Although illustrated with angles A and B being equal, they may vary to form an asymmetrical cross-sectioned duct. Thus, in either embodiment, duct 44 has a straight taper, as it extends along its longitudinal axis, with each side wall 48, 50 extending along an axis 48*a*, 50*a*, respectively, which converge and intersect beyond the distal end, and with the taper extending from proximal end 52 to distal end 54 of duct 44.

Alternately, the side walls 48, 50 may be arranged to form a non-tapered duct, and instead extend parallel so that the proximal end of the duct is the same size as the distal end. The side walls may still form a non-orthogonal inner angle A, B with respect to base wall 46 or may be orthogonal as noted above—but with the tapered effect simulated by control over the degree the side openings (described below) are opened or closed.

As would be understood, the proximal end 52 of duct 44 forms the inlet to the duct, which is open so that it is in fluid communication with plenum 42 (see FIG. 13), while the distal end 54 of duct 44 may be closed, though it too may have one or more openings, as described below in reference to angled side walls 48, 50. Similarly, the proximal end of base wall 46 and side walls 48, 50 of duct 44 may each have a lip 46*b*. 48*b*, 50*b* that form mounting flanges with a plurality of mounting openings to allow the duct 44 to be fastened by fasteners (such as bolts or metal screws) to plenum 42. Optimally, the size and shaped of the plenum outlet and the size and shape of the inlet of duct 44 are the same to reduce back flow. A gasket or gaskets may be provided between the mounting flanges and plenum 42 to seal the duct against the plenum. Additional intermediate lips 46*c*, 48*c*, and 50*c* may be provided to allow the duct 44 to be assembled in sections, as noted above.

Figure 14A:
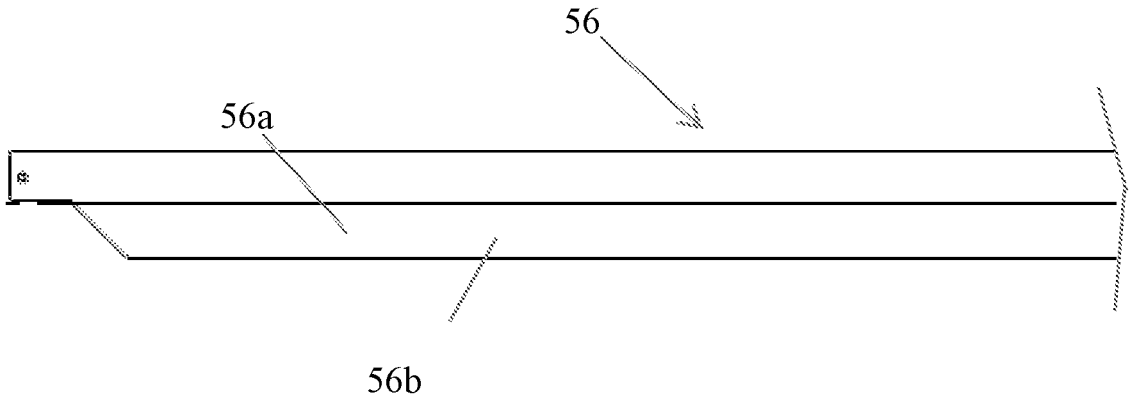
FIG. 14A is an enlarged fragmentary view of a transverse member of the duct of FIG. 14.
Figure 14B:
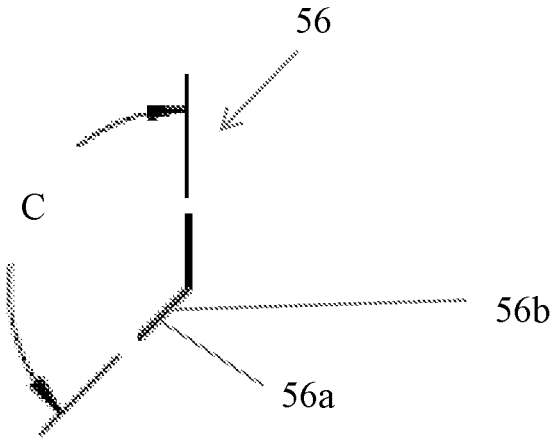
FIG. 14B is a cross-sectional view taken along line XIVB-XIVB of FIG. 14A.

To help maintain the side walls 48, 50 orientation and reinforce duct 44, duct 44 may include one or more transverse members 56. Further, referring to FIGS. 14A and 14B, each transverse member 56 is mounted on its opposed ends to side walls 48, 50 by fasteners and may include a generally L-shaped cross-section. Each transverse member 56 includes a lower leg 56*a* that forms an angled surface 56*b* that faces the proximal end 52 of duct 44 (i.e., faces the inlet of duct 44). In this manner as air flows across transverse members 56, the air will flow smoothly over (and not create local turbulent flow). For example, the lower leg 56*a* may form an inside angle C (FIG. 14B) with respect to its upper leg in a range of 95 to 175 degrees, or about 135 degrees. Thus, angled surface 56*b* faces but is angled away from the proximal end 52 of duct 44 (i.e., angled toward the inlet of duct 44). In this manner as air flows across transverse members 56, the air will flow smoothly over (and not create local turbulent flow). Additionally, the angled surfaces 56*b* of the transverse members 56 may direct the airflow downwardly (at least locally), which may further assist in the control of the air flow described below. This smooth tapered shape of duct 44 allows the air to follow the natural trajectories, while still directing it with outlet openings and optional adjustable plates that form vents, which create a high level of airflow symmetry within the working space (both described below).

Referring again to FIGS. 14 and 16, duct 44 includes a plurality of openings 60 along its length and sides (in side walls 48, 50) to direct the air flow laterally outward (at least initially) from duct 44. Further, due to the angled orientation of side walls 48, 50, openings 60 are angled downwardly at an angle in a range of about 10 to 90 degrees, about 30 to 60 degrees, or 40 to 50 degrees and, optionally, about 45 degrees. Alternately, side walls 48 and 50 may form a 90 degree angle with respect to base wall 50 so that the openings are facing perpendicular to the ceiling or floor of test chamber 14. It has been found that the test chamber ("working space") is washed with airflow better when more air is coming out of the sides. Hence, duct 44 may not include any openings (other than drain openings described below) in the base wall 46. Stated another way, duct 44 may not include any air flow openings in the base wall 46.

In the illustrated embodiment, openings 60 are arranged in groups, for example, at least in two groups, three groups, four groups, or five groups or more. Each opening 60 forms a flow area for the air to flow through the side of the duct. The groups on one side of duct may be aligned (as shown) with the groups on the opposed side of the duct, or they may be offset. Thus, each group of openings forms a vent with a flow area in a respective side of the duct. The number of groups (and hence vents) may vary depending on the size of the chamber and length of the duct. For example, for a duct 44 with a length in a range of about 12 to 16 ft., openings 60 may be arranged in four groups (as shown in FIGS.

14-16), optionally with each opening having a uniform size and shape within each group and optionally within all the groups. For ducts 44 having a length in a range of about 6 to 8 ft., openings 60 may be arranged in two groups as shown in reference to FIG. 18.

In addition, each group of openings may be adjusted or varied. For example, referring to FIGS. 15 and 17, each group of openings on each side of duct 44 may include a slidable plate 64 mounted to the respective side wall 48, 50 (on its outwardly facing surface) over their respective openings 60 to form an adjustable vent. For example, plates 64 may be mounted to side walls 48, 50 by fasteners 64*a* received in slotted openings formed in plates 64 to allow the plates 64 to slide relative to the fasteners 64*a* and relative to openings 60. In another embodiment, the slidable plates 68 may be mounted to side walls 48, 50 via a pair of parallel guides, for example formed by a pair of angle members mounted to the side walls 48, 50. When a respective slide plate 64 is slid along the longitudinal axis of the duct, the slide plate 64 opens or closes or partially opens or closes some or all the openings of a respective group of openings on the respective side to reduce the air flow from that respective group of openings.

For example, each respective slidable plate 64 may have openings 66 that have the same size, shape, and pattern as openings 60 of its respective group of openings. Thus, when a slidable plate 64 is slid to fully align its openings 66 with openings 60 of its respective group of openings 60, the airflow will be unrestricted from the openings 60 of the respective group of openings. When slidable plate 64 is slid to partially cover each opening 60, then the air flow will be at least partially restricted (air flow area will be reduced) from that respective group of openings to form adjustable vents. When slidable plate 64 is slid to fully cover each opening 60 with its respective group of openings, then the air flow will be blocked and fully restricted from that respective group of openings. In this manner, as noted, slide plates 64 form adjustable vents.

Each slide plate may be independently adjusted so that the percentage of closure of the openings in each respective group can be varied along the length of duct 44 and/or from side to side. Further, they may be manually adjusted to suit the particular application and chamber size and shape.

In one embodiment, the duct 44 may include multiple groups of openings, with each group of openings forming a vent. The slidable plates 64 over the openings in the group of openings closest (the first group) to the inlet of duct 44, may be positioned so that their openings fully align and do not cover the openings in that group so that the vent formed by that group of openings is 100% open. Each subsequent group of openings may have their respective slide plate positioned to provide the vents with a reduced percentage, which percentage optionally uniformly decreases along the length of the duct. The reduction may be made in equal increments to form a uniform stepped profile or may be varied.

For example, in one unit with a working space of 1800 cubic feet (with an internal plenum), the duct was configured to include four groups of openings. The slidable plates 64 over the openings in the group of openings closest (the first group) to the inlet of duct 44 were positioned so that their openings fully align and did not cover the openings in that group so that the vent formed by that group of openings was 100% open. The second group closest to the inlet had its slidable plate moved so that only 75% of the vent was open. The third group closest to the inlet had its slidable plate slid so that only 50% of the vent was open. The furthest group from the inlet had its slidable plate slid so that only 25% of the vent was open. In this unit, it was found that with a test profile with a temperature variation of +85 degrees Celsius (C) and −30 degrees Celsius (C), the temperature gradient was less than 2.5 degrees Celsius (C) at −30 degrees Celsius (C), and less than 2.6 degrees Celsius (C) at +85 degrees Celsius (C).

In the illustrated embodiment, openings 60 and 66 are slotted openings with their long axis extending vertically. It should be understood that the size, shape, and number of the openings may be uniform or vary.

Alternately, as described below in reference to the use of two or more ducts, the openings may vary in size and shape and/or be evenly spaced along the length of the duct so they are not arranged in groups.

Thus, duct 44 is configured to keep the velocity higher as the air travels and as the geometry decreases down the length of the duct, which would also help prevent air from short cycling back to the return location.

As noted above, distal end of duct 44 may be closed, for example, by an end wall 70 (FIGS. 14 and 17) secured to lips formed at the distal ends of walls 46, 48, and 50 that form mounting flanges similar to lips 46*a*, 48*a*, and 50*a*. End wall 70 may be imperforate (free of any openings) and as a result form a closed end. Alternately, similar to side walls 48 and 50, end wall 70 may have one or more openings, which may be adjustable to vary the flow of end through the distal end of duct 44, and have a slide plate to open, partially open, or close the vent formed buy the opening or openings.

To drain liquids that may occur (e.g. due to condensation), duct 44 may also include drain holes 72, for example, located in base wall 46 (FIGS. 14 and 15). In one embodiment, each duct section of duct 44 may include a drain hole. Other than the drain holes, base wall 46 may be free of any air flow openings.

Figure 13:
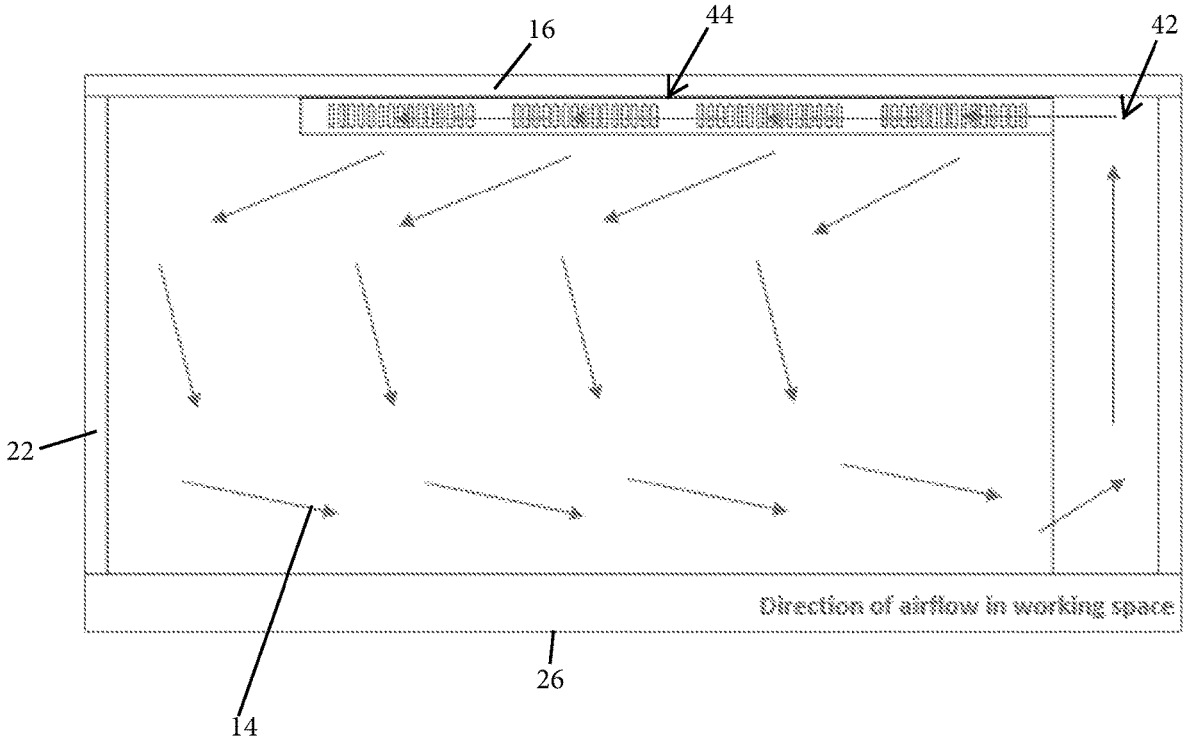
FIG. 13 is a side elevation view of the environmental condition equipment of FIG. 9.

Referring to FIG. 13, when air flows from plenum 42 into duct 44, the air will flow from each vent initially laterally outward from duct 44 and then forwardly (toward distal end of duct) and downwardly (as shown by the arrows). After flowing forwardly and downwardly, it has been found that the air then flows rearwardly and downwardly and thereafter more rearwardly, and then to the return vent 45 of plenum 42 (whether an interior plenum 42*b* or exterior plenum 42*a*) for recycling by air treatment system 40.

As noted above, air treatment system 40 may raise or lower the air temperature, increase or decrease humidity of the air, can increase or decrease the pressure in the air, and/or can treat the air, such as with UV or chemicals, and direct the treated air via plenum 42 into duct 44. For example, air treatment system 40 may include a refrigeration system having an evaporator coil assembly made up of one or more evaporator coils and a fluid circuit for routing refrigerant through the evaporator coil or coils. Air treatment system 40 may include heating coils for heating treating the air or have an operating refrigeration system with a heat pump mode. For further details of suitable air treatment systems, reference is made to U.S. Pat. No. 6,272,767, which are incorporated by reference in their entireties herein.

As noted above, plenum 42 may comprise an external plenum 42*a*. To accommodate an external plenum, duct 44 may include a transition duct 80 (FIG. 10) to direct the air flow from the external plenum 42*a* to duct 44.

Figure 18:
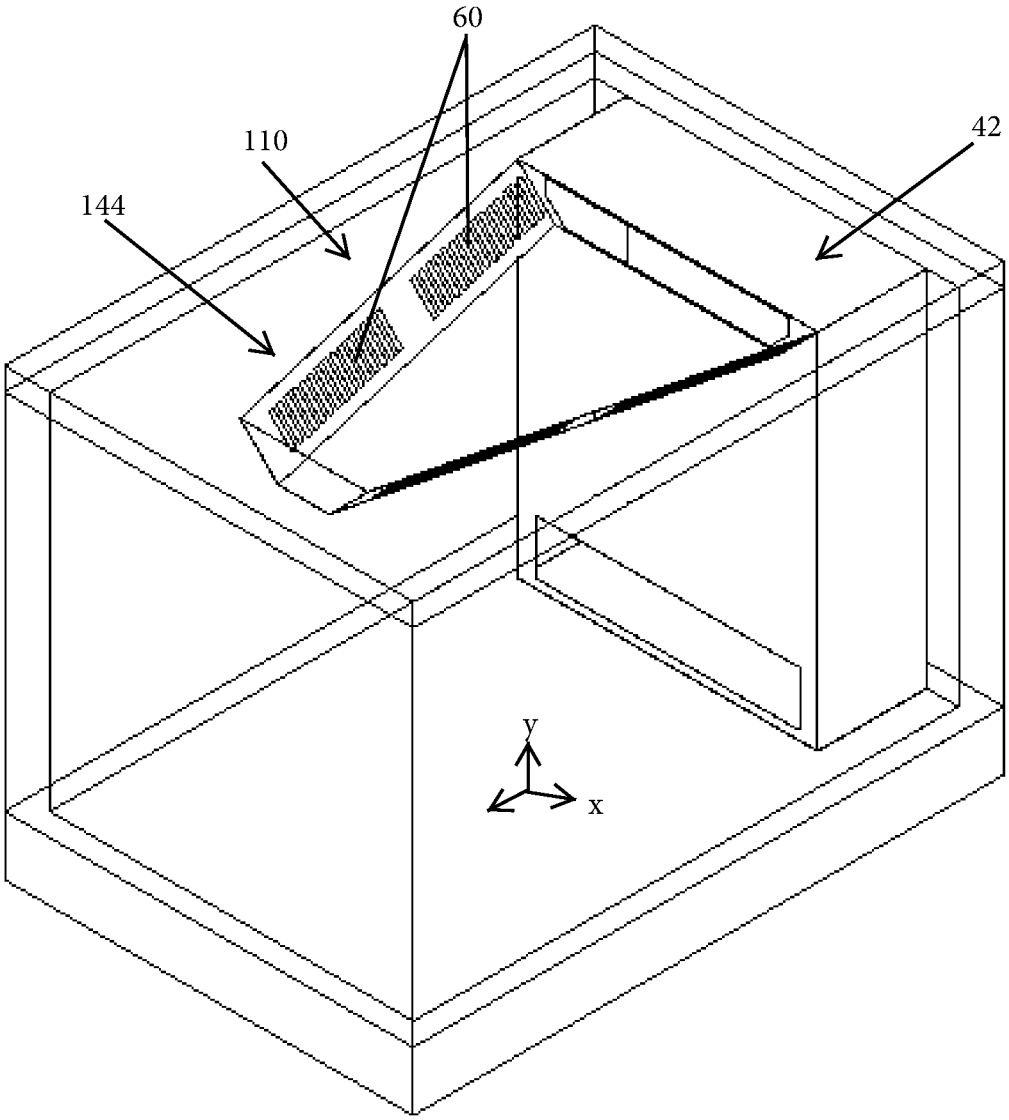
FIG. 18 is a perspective view of another embodiment of the environmental conditioning equipment illustrating a smaller working space.

As noted above, the length of the duct may vary. For example, as illustrated in FIG. 18, for smaller workspaces, environmental conditioning chamber 110 includes a duct 144 with a length in a range of about 6 to 8 ft. with a reduced number of openings 60—or groups of openings. For example, as best seen in FIG. 18, duct 144 includes two groups of openings 60 on each side. Similar to the previous embodiment, each group of openings may be provided with a slide plate, such as described above.

Figure 19:
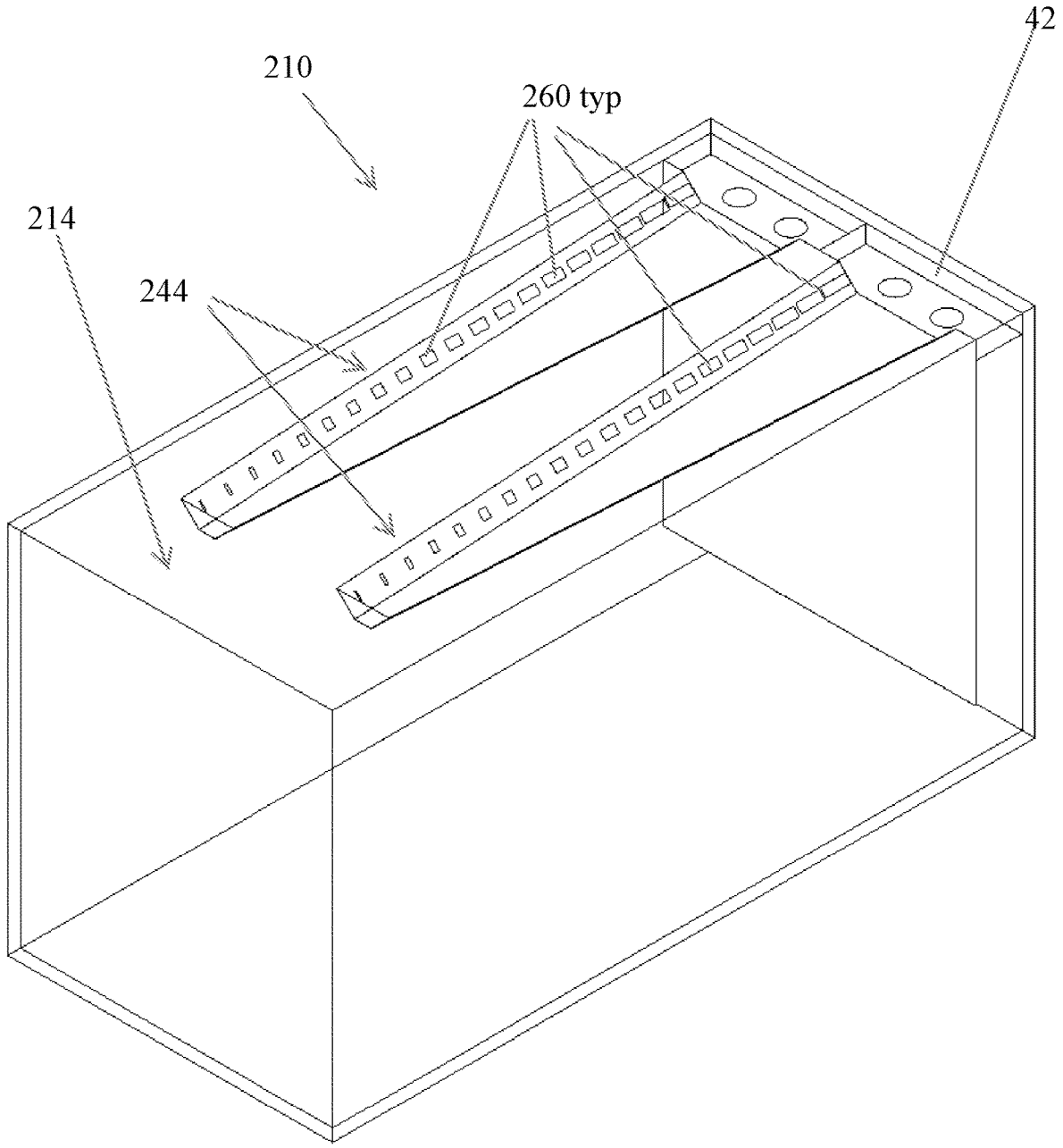
FIG. 19 is a perspective view of another embodiment of the environmental conditioning equipment illustrating a wider working space using two ducts.

In yet another embodiment, as illustrated in FIG. 19, for an environmental conditioning chamber 210 with a wider chamber 214 that forms a wider workspace, chamber 214 may include two or more ducts 244. Ducts 244 may be similar in construction to ducts 44 and, therefore, reference is made to the above description. Further, each duct 244 may be in fluid communication with a common plenum or a dedicated plenum so that each duct 244 may be independently controlled. For example, the air flow in ducts 244 may be the same or may be varied. One duct may deliver one treatment while the other ducts deliver another treatment or merely deliver the same treatment in a different sequence—though they may overlap in time.

Alternately, each duct 244 may have openings 260 arranged along its longitudinal axis in each side wall in spaced intervals with the openings varying in size to eliminate the need for sliding plates—though they may still be employed. The intervals may be uniform or may vary. For example, as best seen in FIG. 19, duct 244 includes openings 260 on each side, which are uniformly spaced, but with each opening decreasing in size along the longitudinal axis. Similar to the previous embodiments, each opening or group of openings may be provided with a slide plate, such as described above.

Thus, a method of directing air though a chamber of environmental conditioning equipment to improve temperature distribution in the chamber is disclosed by providing a duct in the equipment chamber at the upper wall of the chamber. Further, the duct is formed with two opposed sides and a bottom wall, which form the cross-section of the duct. The method further includes providing a plurality of side openings in the opposed sides of the duct, which are arranged to increase the velocity of air as it flows along the longitudinal axis of the duct as the cross-section of the duct decreases, while allowing some of the air flow to flow laterally outward from the duct through decreasing flow areas formed by the air flow openings.

While not illustrated, other test equipment, such as vibration tables, humidification systems, dehumidification systems, water spray devices, product cycling fixtures, and the like, can be positioned in chamber 14 or plenum 42 to provide additional tests to the units-under-test. While the foregoing description describes several embodiments of the present disclosure, it will be understood by those skilled in the art that variations and modifications to these embodiments may be made without departing from the spirit and scope of the disclosure, as defined in the claims below. The present disclosure encompasses all combinations of various embodiments or aspects of the disclosure described herein. It is understood that any and all embodiments of the present disclosure may be taken in conjunction with any other embodiment to describe additional embodiments of the present disclosure. Furthermore, any elements of an embodiment may be combined with any and all other elements of any of the embodiments to describe additional embodiments.

We claim:

1. An environmental conditioning equipment comprising:

a chamber having an upper wall forming a ceiling of the chamber, two opposed side walls, two opposed end walls, and a lower wall forming a floor of said chamber;

a plenum and an air-moving apparatus for directing air into said chamber; and a duct having a proximal end, a distal end, and a longitudinal axis extending between said proximal end to said distal end and being mounted at said upper wall of said chamber, said duct being in fluid communication with said plenum at said proximal end, said duct having sides and being formed from a base wall and opposed side walls forming said sides and an exterior of said duct, said base wall and said opposed side walls forming a cross-section defining an air flow area of said duct, said base wall having a length extending along said longitudinal axis and facing and being parallel to said floor of said chamber, said opposed side walls being angled with respect to said base wall, and said base wall being free of air flow openings; and each of said opposed side walls having a plurality air flow openings configured to direct fluid outwardly from said opposed side walls of said duct, and said cross-section and said air flow area of said duct decreasing along said longitudinal axis wherein the exterior of the duct tapers from its proximal end to its distal end.

2. The environmental conditioning equipment according to claim 1, wherein said plurality of said air flow openings is arranged in groups.

3. The environmental conditioning equipment according to claim 2, wherein a first side wall of said opposed side walls has at least two groups of said air flow openings, and a second side wall of said opposed side walls has at least two groups of said air flow openings, said at least two groups of said air flow openings of said first side wall being aligned with said at least two groups of said air flow openings in said second side wall.

4. The environmental conditioning equipment according to claim 2, wherein said groups have (1) a uniform number of openings, (2) a uniform size of openings, and/or (3) uniform shaped openings.

5. The environmental conditioning equipment according to claim 3, wherein each group of said groups includes a plurality of air flow openings, said air flow openings of each group comprise uniformly sized and shaped slotted air flow openings spaced uniformly along said longitudinal axis of said duct.

6. The environmental conditioning equipment according to claim 1, wherein said plurality of air flow openings are adjustable to vary said flow area along said longitudinal axis.

7. The environmental conditioning equipment according to claim 6, wherein said air flow openings are arranged in groups of openings, each respective group of openings having a slidable plate extending over said respective group of openings to adjust the flow area of each respective group of openings.

8. The environmental conditioning equipment according to claim 1, wherein said duct includes an end wall at said distal end, and said end wall being closed and being free of air flow openings.

9. The environmental conditioning equipment according to claim 1, wherein said air flow openings are arranged in each respective side wall of said opposed side walls along said longitudinal axes, said air flow openings each having a size, and said air flow openings in each respective side wall decreasing in size along said longitudinal axes.

10. The environmental conditioning equipment according to claim 1, wherein said longitudinal axis of said duct is angled with respect to said upper wall wherein said duct is not horizontal.

11. The environmental conditioning equipment according to claim 1, wherein said duct comprises a first duct, said environmental conditioning equipment further comprising a second duct.

12. The environmental conditioning equipment according to claim 11, wherein said second duct has a second proximal end, a second distal end, and a second longitudinal axis extending between said second proximal end to said second distal end of said second duct and being mounted at said upper wall of said chamber adjacent said first duct, said second duct being in fluid communication with said plenum or a second plenum at said proximal end, said second duct having second sides and being formed from a second base wall and second opposed side walls forming said second sides of said second duct, said second base wall of said second duct being free of air flow openings, and each of said second side walls of said second duct having a second plurality air flow openings configured to direct fluid outwardly from said second sides of said second duct and forming a second air flow area that decreases along said second longitudinal axis of said second duct.

13. The environmental conditioning equipment according to claim 1, wherein said duct is formed from a plurality of duct sections joined together at spaced connections, each of said duct sections having from a base wall section, opposed side wall sections joined together to form said base wall and said opposed side walls of said duct, and a group of said plurality of air flow openings in each of said opposed side wall sections.

14. The environmental conditioning equipment according to claim 13, further comprising a sliding plate extending over one or more respective groups of said plurality of air flow openings to adjust the flow area of said one or more respective groups of said plurality of air flow openings.

15. An environmental conditioning equipment comprising:

a chamber having an upper wall forming a ceiling of the chamber, two opposed side walls, two opposed end walls, and a lower wall forming a floor of said chamber;

a plenum and an air-moving apparatus for directing air into said chamber; and a duct having a proximal end, a distal end, and a longitudinal axis extending between said proximal end to said distal end and being mounted at said upper wall of said chamber, said duct being in fluid communication with said plenum at said proximal end, said duct having sides and being formed from a base wall and opposed side walls forming said sides of said duct, said base wall being free of air flow openings, and each of said side walls having a plurality air flow openings configured to direct fluid outwardly from said sides of said duct and forming an air flow area that decreases along said longitudinal axis, wherein each of said side walls extends along a respective longitudinal axis, and said respective longitudinal axes converging toward said distal end of said duct wherein said duct is tapered inwardly from said proximal end to said distal end.

16. The environmental conditioning equipment according to claim 15, wherein said plurality of air flow openings is arranged in groups, further comprising a sliding plate extending over one or more respective groups of said plurality of air flow openings to adjust the flow area of said one or more respective groups of said plurality of air flow openings.

17. An environmental conditioning equipment comprising:

a chamber having an upper wall forming a ceiling of the chamber, two opposed side walls, two opposed end walls, and a lower wall forming a floor of said chamber;

a plenum and an air-moving apparatus for directing air into said chamber; and a duct having a proximal end, a distal end, and a longitudinal axis extending between said proximal end to said distal end and being mounted at said upper wall of said chamber, said duct being in fluid communication with said plenum at said proximal end, said duct having sides and being formed from a base wall and opposed side walls forming said sides of said duct, said base wall being free of air flow openings, and each of said side walls having a plurality air flow openings configured to direct fluid outwardly from said sides of said duct and forming an air flow area that decreases along said longitudinal axis, wherein said side walls form inner obtuse angles with respect to said base wall wherein said duct has a trapezoidal cross-section and said air flow openings are angled downwardly toward said floor.

18. The environmental conditioning equipment according to claim 17 wherein said inner obtuse angles are approximately equal wherein said duct has a symmetrical trapezoidal cross-section.

19. An environmental conditioning equipment comprising:

a chamber having an upper wall forming a ceiling of the chamber, two opposed side walls, two opposed end walls, and a lower wall forming a floor of said chamber;

a plenum and an air-moving apparatus for directing air into said chamber; and a duct having a proximal end, a distal end, and a longitudinal axis extending between said proximal end to said distal end and being mounted at said upper wall of said chamber, said duct being in fluid communication with said plenum at said proximal end, said duct having sides and being formed from a base wall and opposed side walls forming said sides of said duct, said base wall being free of air flow openings, and each of said side walls having a plurality air flow openings configured to direct fluid outwardly from said sides of said duct and forming an air flow area that decreases along said longitudinal axis, wherein said duct includes a plurality of transverse members extending between said opposed side walls, said transverse members each having an angled surface facing said proximate end of said duct to help direct the flow of air toward said base wall in said duct.

20. The environmental conditioning equipment according to claim 19, wherein said duct is formed from a plurality of duct sections joined together at spaced connections, each duct section being formed from a base wall section and opposed side wall sections joined together to form said base wall and said opposed side walls of said duct, and said transverse members being mounted at said spaced connections.

21. A method of directing air though a chamber of environmental conditioning equipment to improve temperature distribution in the chamber, the environmental conditioning equipment having a plenum and an air-moving apparatus for directing air into the chamber, the chamber having an upper wall forming a ceiling and a lower wall forming a floor of said chamber, said method comprising;

providing a duct in the chamber at the upper wall of the chamber;

forming the duct with two opposed sides and a bottom wall forming a cross-section of the duct, the bottom wall for facing and being parallel to the floor of the chamber and being free of air flow openings, and the opposed side walls being angled with respect to the base wall and forming an exterior of the duct, the duct having a proximal end, a distal end, and a longitudinal axis extending between the proximal end and the distal end, and the cross-section of the duct decreasing from the proximal end to the distal end wherein the exterior of the duct tapers from its proximal end to its distal end;

providing a plurality of air flow openings in the opposed side walls;

spacing the air flow openings along the longitudinal axis, and the air flow openings each providing an air flow area;

directing air flow into the proximal end of the duct from the plenum and air-moving apparatus; and increasing the velocity of air as it flows along the longitudinal axis of the duct as the cross-section of the duct decreases while allowing some of the air flow to flow laterally outward from the duct through the opposed side walls and the flow areas formed by the air flow openings along the longitudinal axis of the duct.

22. The method according to claim 21, further comprising arranging the air flow openings in groups.

23. The method according to claim 21, further comprising adjusting the air flow areas of the air flow openings in the groups so that the air flow areas in the groups of air flow openings closest to the proximal end are greater than the air flow areas in the groups of air flow openings furthest from the proximal end of the duct.

* * * * *